United States Patent [19]

Blanke, Jr. et al.

[11] Patent Number: 4,493,127

[45] Date of Patent: Jan. 15, 1985

[54] CARRYING HANDLE FOR HEAVY DUTY OLEFIN BAGS

[75] Inventors: Richard H. Blanke, Jr., Ladue; Harold N. Cale, Chesterfield, both of Mo.

[73] Assignee: Chase Bag Company, Greenwich, Conn.

[21] Appl. No.: 408,209

[22] Filed: Aug. 16, 1982

[51] Int. Cl.[3] ..... B65D 25/28

[52] U.S. Cl. ..... 16/124; 16/110 R; 16/DIG. 19; 16/DIG. 24; 294/27 H; 383/15; 383/29

[58] Field of Search ..... 16/110 R, 110.5, 114 R, 16/124, 125, DIG. 12, DIG. 18, DIG. 19, DIG. 24, DIG. 25, DIG. 40; 383/13, 15, 29; 294/27 R, 27 H; 220/94 R, 94 A; D9/434; 403/311, 364

[56] References Cited

U.S. PATENT DOCUMENTS

| | | | |
|---|---|---|---|
| 757,812 | 4/1904 | Keyes | 403/364 |
| 2,846,134 | 8/1958 | Moubayed . | |
| 3,105,628 | 10/1963 | Mack | 383/20 |
| 3,298,416 | 1/1967 | Grady | 16/110 R |
| 3,383,029 | 5/1968 | Reade | 229/52 A X |
| 3,529,317 | 9/1970 | Schwarzkopf | 16/110 R |
| 3,529,599 | 9/1970 | Folkman . | |
| 3,559,873 | 2/1971 | Hart | 229/52 A X |
| 3,722,786 | 3/1973 | Honn . | |
| 3,757,385 | 9/1973 | Schwartzkopf . | |

OTHER PUBLICATIONS

Goplen et al., Latch Structure for Tool or Finger Operation, I.B.M. Technical Disclosure Bulletin, vol. 22, No. 6, Nov. 1979.

*Primary Examiner*—Fred A. Silverberg
*Attorney, Agent, or Firm*—Jacobs & Jacobs

[57] ABSTRACT

The invention provides a molded plastic handle for attachment to the upper end of a heavy duty olefin bag for packaging dry mix and the like, wherein the handle is provided with a hand-engaging opening, has an integrally formed depending skirt of alternating depending portions adapted to be sonically or impulse sealed to the outer surfaces of the upper edge portion of the olefin bag, with each of the depending surfaces so arranged that they do not overlap or correspond position-wise to the skirt depending element on the opposite side of the olefin bag, one of the depending portions being disposed midway along the handle, and a vertical strut being provided connecting the handle top portion to such midway depending portion. The invention also provides integrally formed reinforcing ribs at each side of the handle, on front and back faces, with downwardly bifurcated ends which extend to two end skirt portions, and thereby reinforce such end portions to equalize the load stress on the handle and top of the bag.

6 Claims, 5 Drawing Figures

FIG. 1
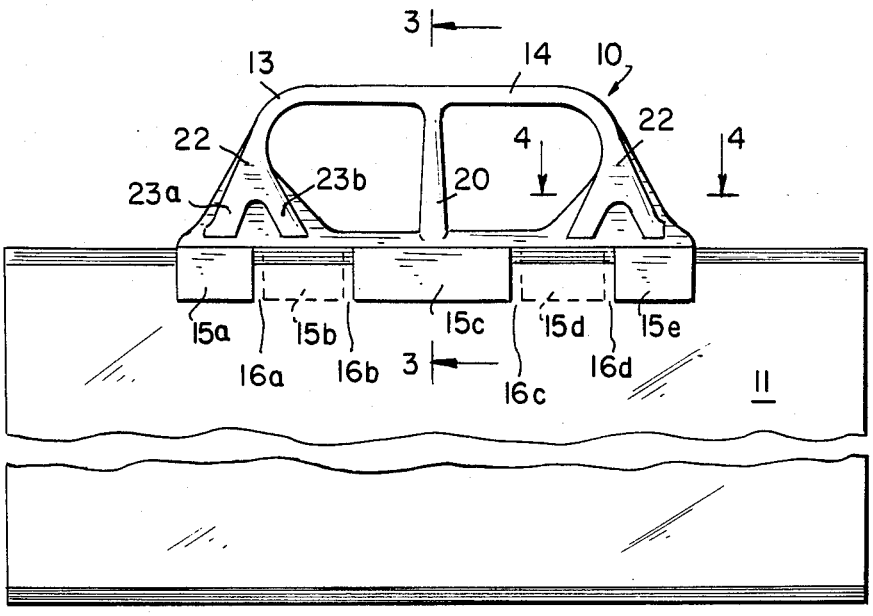
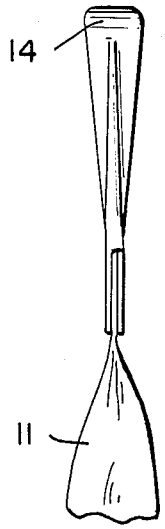
FIG. 2
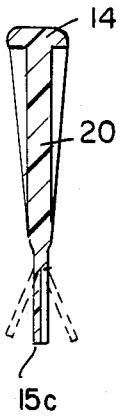
FIG. 3
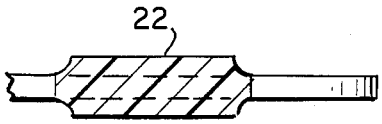
FIG. 4
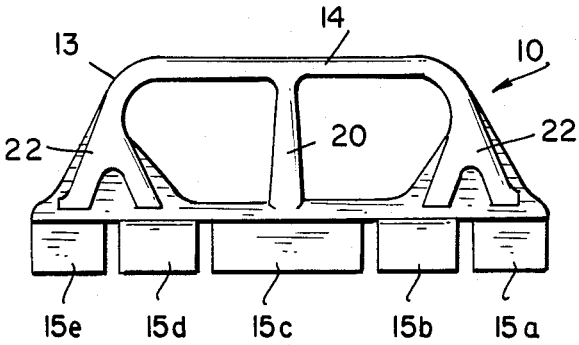
FIG. 5

CARRYING HANDLE FOR HEAVY DUTY OLEFIN BAGS

The present invention relates to a carrying handle and bag construction. More particularly, it relates to bag handles for application to olefin bags wherein a dry mix of various materials is suitably packaged, —such bags of dry mix usually weighing between 10 and 50 pounds.

The invention provides a molded handle for attachment to a heavy duty olefin bag having an interrupted skirt portion for attachment to the bag which is so constructed that the entire load stress is equally distributed along the entire skirt area. Also, the invention provides a molded handle of the type described which requires 35% less material while performing the same function and purpose as prior art handles. The handle is also so constructed as to provide more hand comfort to the person carrying the bagged merchandise.

SUMMARY OF THE INVENTION

The present invention provides a molded plastic handle for attachment to the upper end of a heavy duty olefin bag for packaging dry mix and the like, wherein the handle is provided with a hand-engaging opening, has an integrally formed depending skirt or alternating depending portions adapted to be sonically or impulse sealed to the outer surfaces of the upper edge portion of the olefin bag, with each of the depending surfaces so arranged that they do not overlap or correspond positionwise to the skirt depending element on the opposite side of the olefin bag, one of said depending portions being disposed midway along the handle, and a vertical strut being provided connecting the handle top portion to such midway depending portion whereby such strut prevents bending stresses at the middle of such interrupted skirt portion and thereby equalizes the stress over the entire interrupted skirt portions. The invention also provides integrally formed reinforcing ribs at each side of the handle, on front and back faces, with downwardly bifurcated ends which extend to two end skirt portions, and thereby reinforce such end portions to equalize the load stress on the handle and top of the bag.

PRIOR ART

According to applicants' best knowledge the following patents are most pertinent to the present invention: Moubayed U.S. Pat. No. 2,846,134; Mack U.S. Pat. No. 3,105,628; Grady U.S. Pat. No. 3,298,416; Schwarzkopf U.S. Pat. No. 3,529,317; Folkman et al. U.S. Pat. No. 3,529,599; Honn et al. U.S. Pat. No. 3,722,786; and Schwarzkopf U.S. Pat. No. 3,757,385. Also applicants' earlier application Ser. No. 83,788, filed Oct. 11, 1979, is acknowledged to be prior art over which the present invention is believed to represent a substantial improvement.

In commenting on the prior art patents applicants submit that all of such prior art patents with the exception of Grady U.S. Pat. No. 3,298,416 and applicants' pending application Ser. No. 83,788, merely disclose handles for shopping bags and only have light-weight carrying ability. Concerning the Grady U.S. Pat. No. 3,298,416, among its other short comings it provides an uninterrupted or V-shaped skirt portion for attachment to the bag which is difficult to seal sonically to the bag. Applicants' earlier application Ser. No. 83,788 is the pioneer of the present invention in that is does disclose the interrupted skirt portion for sonic or impulse sealing to the bag. It falls short of meeting the later advantages provided by the present invention, in that it fails to provide equal load stress on all of the skirt elements and bag segments sonically sealed thereto. Also, the Grady construction requires at least 35% more material for each handle than does the present invention.

DETAILED DESCRIPTION OF THE INVENTION

For a better understanding of the invention reference will now be made to the accompanying drawings wherein:

FIG. 1 is an elevational view partly in section showing the handle of the present invention applied to a heavy duty olefin bag.

FIG. 2 is a side view of the handle and bag shown in FIG. 1.

FIG. 3 is a sectional view taken through the handle along the line 3—3 and viewed in the direction of the arrows.

FIG. 4 is a sectional view taken along the line 4—4 of FIG. 1 and viewed in the direction of the arrows.

FIG. 5 is an elevational view of the reverse side of the handle shown in FIG. 1 without the attached bag.

Referring more particularly to the drawings, the handle provided by the present invention is generally indicated as 10, and the olefin bag to which the handle is sonically or impulse sealed at its upper end is generally indicated as 11. It will be noted that the handle 10 has a hand engaging or holding portion 13 including a horizontal bar portion 14 and depending interrupted skirt portions 15*a*, 15*b*, 15*c*, 15*d* and 15*e* disposed along its bottom edge and separated from each other by slots 16*a*, 16*b*, 16*c* and 16*d*.

According to the present invention and as disclosed in applicants' earlier application Ser. No. 83,788, filed Oct. 11, 1979, the skirt portions 15*a*, 15*b*, 15*c*, 15*d* and 15*e* are sonically or impulse sealed to the upper end of the heavy duty olefin bag 11 in alternate arrangement so that the interrupted skirt elements 15*a*, 15*c* and 15*e* are on one side of the bag as shown in full lines in FIG. 1; whereas, the skirt elements 15*b* and 15*d* are sonically or impulse sealed to the opposite side of the bag as shown by dotted lines in FIG. 1.

The features of novelty provided by the present invention in contrast with applicants' earlier patent application Ser. No. 83,788, filed Oct. 11, 1979, are: a handle 10 is provided with a central strut 20 which is connected to the upper bar 14 of the handle 10 and is also directly connected to the midway skirt portion 15*c*; and along each of the sides, front and rear faces of the molded handle 10, there is provided reinforcing bifurcated ribs 22, each of which at their lower edges 23*a*, 23*b* match up or coincide with interrupted skirt portions 15*a*, 15*b*, 15*d* and 15*e* so as to provide reinforcement for the handle 10 in supporting the bag 11. From a practical standpoint, in molding the handle 10 the reinforcing bifurcated sections 22 are provided on the front and rear faces of the handle as shown in FIGS. 1 and 5. However, the bifurcated ends 23*a* and 23*b* of reinforcing strips 22 on the front face of the handle provide strengthening support for skirt portions 15*a* and 15*e*; whereas, the bifurcated ends of reinforcing member 22 on the rear side, as shown in FIGS. 1 and 5, provide strengthening support for skirt portions 15*b* and 15*d*.

In addition to the structural advantages set forth above, the handle of the present invention uses 35% less raw material than does the handle shown in Grady U.S. Pat. No. 3,298,416. The handle of the present invention weighs 7 grams, whereas the Grady handle weighs 9.5 grams. As the handles have a one-time use and have a petrochemical base, the present handle contributes a substantial savings or reduction in waste of petrochemical materials.

What we claim is:

1. A molded plastic handle adapted to be sonically sealed to the upper, outer surfaces of a heavy duty olefin carrying bag for carrying 10 to 50 pounds of dry mix and like heavyweight material, comprising:

(a) a hand receiving portion having inwardly and outwardly flared ends;

(b) a depending slotted skirt portion below said hand receiving portion and connected to said flared ends, said depending skirt portion having depending alternate elements for attachment to the outer surfaces of such olefin bag, said depending alternate elements being spaced apart to provide a slot between each pair of adjacent elements, and one said depending alternating element being disposed midway of said handle;

(c) each of said alternating elements being of a size and configuration not to overlap the alternating elements immediately adjacent thereto when secured to the upper surface of the olefin bag; and (d) a vertical strut integral with said hand receiving portion of the handle and connected to said midway depending element, whereby the interrupted skirt portion is prevented from flexing under load stress.

2. A molded plastic handle according to claim 1, having along its front side edges a reinforcing rib outwardly bifurcated at its lower end to provide reinforcing immediately above two skirt elements.

3. A molded plastic handle according to claim 1, having along its side edges, both front and back, reinforcing ribs outwardly bifurcated at their lower ends to provide reinforcing immediately above the two skirt elements at each end of the handle.

4. A molded plastic handle adapted to be impulse sealed to the upper, outer surfaces of a heavy duty olefin carrying bag for carrying 10 to 50 pounds of dry mix and like heavyweight material, comprising (a) a hand receiving portion having inwardly and outwardly flared ends;

(b) a depending slotted skirt portion below said hand receiving portion and connected to said flared ends, said depending skirt portion having depending alternate elements for attachment to the outer surfaces of such olefin bag, said depending alternate elements being spaced apart to provide a slot between each pair of adjacent elements, and one said depending alternating element being disposed midway of said handle;

(c) each of said alternating elements being of a size and configuration not to overlap the alternating elements immediately adjacent thereto when secured to the upper surface of the olefin bag; and (d) a vertical strut integral with said hand receiving portion of the handle and connected to said midway depending element, whereby the interrupted skirt portion is prevented from flexing under load stress.

5. A molded plastic handle according to claim 4, having along its front side edges a reinforcing rib outwardly bifurcated at its lower end to provide reinforcing immediately above two skirt elements.

6. A molded plastic handle according to claim 4, having along its side edges, both front and back, reinforcing ribs outwardly bifurcated at their lower ends to provide reinforcing immediately above the two skirt elements at each end of the handle.

* * * * *